US007152741B2

(12) United States Patent
Jara et al.

(10) Patent No.: US 7,152,741 B2
(45) Date of Patent: Dec. 26, 2006

(54) USE OF OZONE TO INCREASE THE FLOTATION EFFICIENCY OF SULFIDE MINERALS

(75) Inventors: Javier Jara, Dollard des Ormeux (CA); Yawo Zuttah, Montreal (CA)

(73) Assignees: Air Liquide Canada, Montreal (CA); L'Air Liquide. Sociètè Anonyme à Directoire et Conseil de Surveillance pour l'Étude et l'Exploitation des Procedes Georges Claude, Paris (FR)

( * ) Notice: Subject to any disclaimer, the term of this patent is extended or adjusted under 35 U.S.C. 154(b) by 857 days.

(21) Appl. No.: 10/365,100

(22) Filed: Feb. 12, 2003

(65) Prior Publication Data

US 2003/0231995 A1 Dec. 18, 2003

Related U.S. Application Data

(60) Provisional application No. 60/356,202, filed on Feb. 12, 2002.

(51) Int. Cl.
*B03D 1/002* (2006.01)
*B03D 1/02* (2006.01)
*B03D 1/04* (2006.01)

(52) U.S. Cl. ..... 209/166; 209/167

(58) Field of Classification Search ..... 209/166, 209/167

See application file for complete search history.

(56) References Cited

U.S. PATENT DOCUMENTS 1,869,532 A * 8/1932 Weinig ..... 209/167
1,893,517 A * 1/1933 Gaudin ..... 209/167
2,898,196 A 8/1959 Forward et al.
3,539,002 A 11/1970 Last
4,139,455 A 2/1979 Griffith et al.
4,830,738 A 5/1989 White et al.
5,068,028 A 11/1991 Miller et al.
5,110,455 A 5/1992 Huch
5,122,261 A 6/1992 Hollingsworth
5,687,609 A 11/1997 Schmalzel
5,807,479 A 9/1998 Arbiter
5,902,977 A 5/1999 Arbiter
6,036,025 A 3/2000 Clark et al.

* cited by examiner

*Primary Examiner*—Thomas M. Lithgow
(74) *Attorney, Agent, or Firm*—Elwood L. Haynes

(57) ABSTRACT

The use of ozone during certain stages of metal separation by flotation degrades certain collectors that are absorbed on the particle surface, as well as the collectors and frothers in the liquid slurry. As a result, the mineral particle has a fresh surface and new chemical reagent(s) can be added in the subsequent flotation step(s). Also since ozone oxidizes the iron sulfide particles faster than the other mineral particles, depending upon the duration of treatment, the ozone concentration, and the kg $O_3$/ton consumed by the treated ore, the surface of the iron sulfide particles may be partially or even totally oxidized, thus allowing better separation. As a consequence, the iron content is decreased, and the grade of the mineral value such as zinc, copper, and nickel increases. Also, sulfide emissions during heat treatment or further processing of the minerals are decreased due to decrease iron sulfide content.

64 Claims, 9 Drawing Sheets

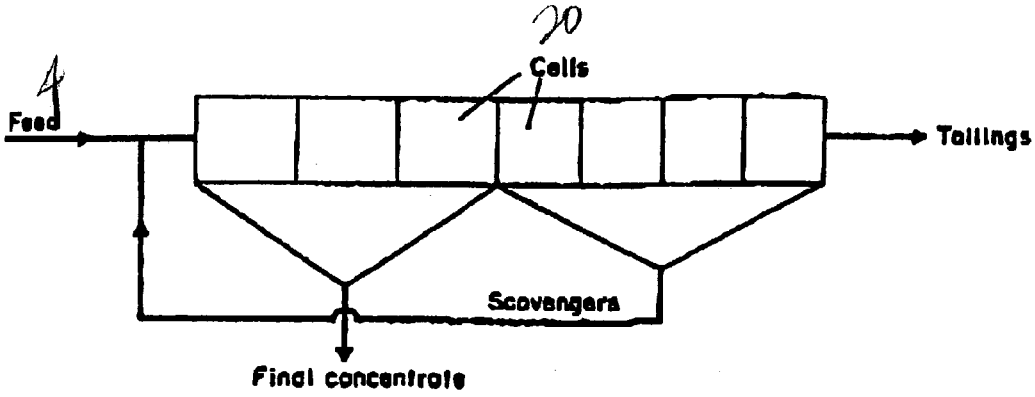
FIG. 4 Simple flotation circuit.
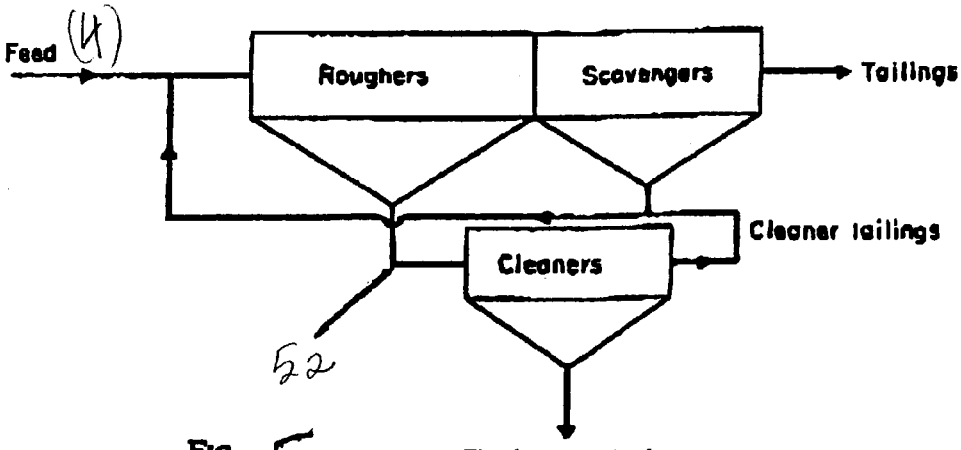
FIG. 5 Rougher-scavenger-cleaner system.

2

| Test | I. D | Ozonation conditions | | Flotation conditions | | | | | | Cumm. distrib,% | | Cumm. Grade,% | |
|---|---|---|---|---|---|---|---|---|---|---|---|---|---|
| | | pH | Kg $O_3$/ton | pH | Time | Gas | Cu | XN | Frother | Zn | Fe | Zn | Fe |
| | | | Feed conc. | | Min | Type | g/t | g/t | g/t | | | | |
| | | | | | | | | | | | | | |
| 1 | ccb8-f | | | 11 | 10 | Air | 0 | 0 | 0 | 78.5 | 67.7 | 58.0 | 7.7 |
| 2 | cc1f | | | 11 | 10 | Air | 0 | 20 | 20 | 97.5 | 95.7 | 55.6 | 8.1 |
| 3 | cc2f | | | 11 | 10 | N2 | 0 | 20 | 20 | 96.2 | 92.6 | 55.6 | 7.8 |
| 4 | cco4-b | 11 | 0.26 | 11 | 10 | Air | 0 | 40 | 20 | 82.0 | 70.0 | 56.9 | 7.3 |
| 5 | cco4-d | 11 | 0.26 | 11 | 10 | Air | 0 | 40 | 20 | 79.4 | 69.9 | 58.2 | 7.7 |
| 6 | Cco10-b | 11 | 0.52 | 11 | 10 | Air | 0 | 40 | 20 | 48.5 | 36.6 | 58.2 | 6.9 |
| 7 | Cco11-b | 11 | 0.52 | 11 | 10 | Air | 0 | 60 | 20 | 72.5 | 58.2 | 58.0 | 6.9 |
| 8 | ocu-a | 11 | 0.26 | 11 | 10 | Air | 20 | 40 | 20 | 88.8 | 78.0 | 57.2 | 7.6 |
| 9 | ocu-c | 11 | 0.52 | 11 | 10 | Air | 20 | 40 | 20 | 73.7 | 62.6 | 56.5 | 7.3 |
| 10 | ocu-d | 11 | 0.52 | 11 | 10 | Air | 50 | 40 | 20 | 69.6 | 57.4 | 57.7 | 7.3 |
| 11 | ocu-e | 11 | 0.78 | 11 | 10 | Air | 50 | 40 | 20 | 58.3 | 45.8 | 57.8 | 6.9 |

Fig. 11 Effect of ozone on flotation efficiency by rejecting iron sulfide from concentrate

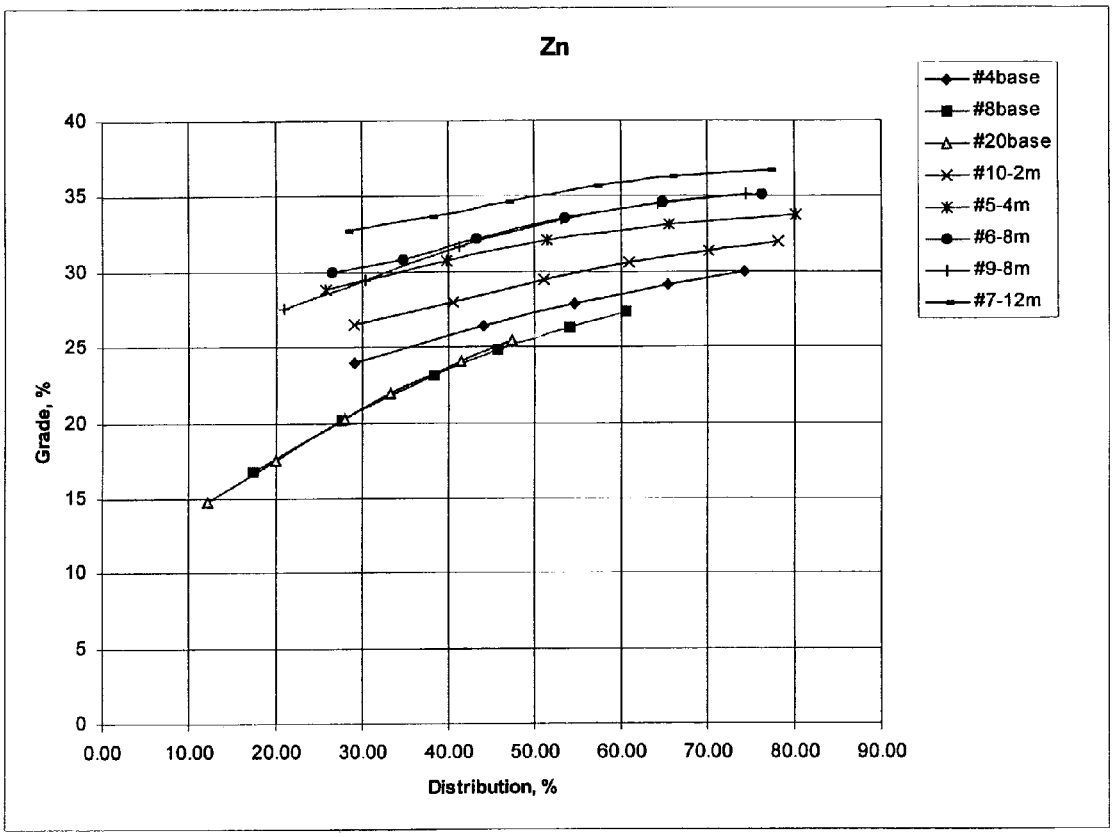
Fig. 12 Zinc grade-recovery: rougher concentrate

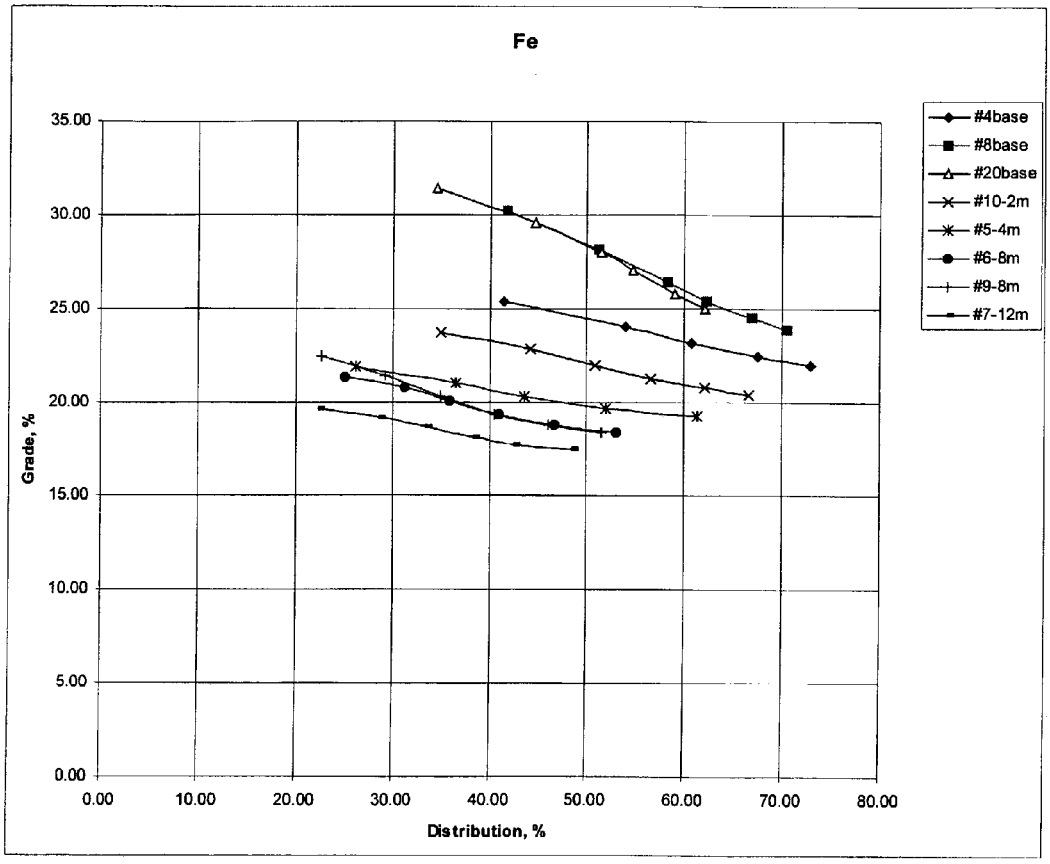
Fig. 13 Iron grade-recovery: Rougher concentrate

USE OF OZONE TO INCREASE THE FLOTATION EFFICIENCY OF SULFIDE MINERALS

RELATED APPLICATIONS

This application claims priority from U.S. Provisional Application No. 60/356,202 filed Feb. 12, 2002.

FIELD OF THE INVENTION

This invention is related to minerals separation by flotation. It provides a method to increase the grade or recovery of metals values such as zinc, copper and nickel by rejecting iron sulfides from the concentrate.

BACKGROUND OF THE INVENTION

A major part of mineral processing involves the separation of desirable minerals from impure ores within which the minerals are contained. The need to control iron is critical in the zinc, copper and nickel industry. Iron is in the form of iron sulfide, mainly pyrite (FeS2) and pyrrhotite (FeS). There are several options for iron management, such as flotation, hydrometallurgical and pyrometallurgical techniques. Further options in mineral processing are: liberation of locked particles by regrinding, feed dilution, reduction of circulating loads or washing the froth using flotation columns. The liberation of locked particles by grinding and/or regrinding is a technique to improve grade of zinc and iron rejection in concentrates. Another method is modifying the surface particle using collectors and the interaction of metal ions and precipitation on the mineral surfaces. Froth flotation is one technique employed to facilitate such separation. Prior to and/or during froth flotation the ore is ground and typically fed as an aqueous slurry to froth flotation cells. The chemistry of the slurry is adjusted at various stages such that certain minerals will selectively attach to air bubbles which rise upward through the slurry and are collected in froth near the top of a flotation cell, while other minerals and or parts such as gangue are hydrophilic and do not attach to the air bubble and sink due to gravity. Thereafter, selected minerals in the froth can be separated from different minerals and/or gangue in the cell.

During this process, the surfaces of specific mineral particles, which are in an aqueous state, are treated with chemicals called flotation reagents or collectors. The flotation reagents cause the desired mineral to be floated with a water-repellent coating that will easily adhere to an air bubble, which will raise the mineral through the slurry to the surface. Froth is also generated by vigorous agitation and/or stirring, and aeration of the slurry in the presence of a frothing agent. The desired mineral separated and collected during the froth flotation process may be either the froth product or the underflow product.

Other chemical agents can be added to the slurry to assist in the separation process, such as depressants or modifiers. The presence of depressants generally assists in selectivity and/or stop unwanted minerals from floating. In contrast, modifiers facilitate collection of desired minerals, and include several classes of chemicals such as activators, alkalinity regulators, and dispersants. Activators are used to make the mineral particle surface amenable to collector coatings. Alkalinity regulators are used to control and adjust pH, an important factor in many flotation separations, while dispersants work to control slimes which can interfere with selectivity and increase reagent consumption.

Flotation processes yields two main products, the concentrate and the tailing. The concentrate contains the metal value, while the tailing contains the gangue or undesired products or components that may also be considered to be wastes and/or less desirable products and/or desired products in a more impure state.

In general, entrainment and liberation are much easier and cheaper to implement than surface modification. However, it worth noting that the faster the removal of iron from the circuit, the cheaper the cost to treat iron. As a consequence, the flotation step is most preferable for dealing with the removal of iron.

Further, the process of reverse flotation in which pyrite is floated and sphalerite is depressed has been used in several mills to reject and control iron sulfides in the zinc final concentrate. Reverse flotation has been practiced on zinc concentrates but the cost of the heat and/or sulfur dioxide needed to de-activate sphalerite generally makes it impractical. Also, this process is environmentally unattractive.

Flotation has also been used to reduce entrainment of the less desirable iron sulfide with other more desirable metal sulfide particles. One such method is to modify the surface particle using collectors and the interaction of metal ions and precipitation on the mineral surfaces. Additionally, along with the collectors and/or frothers, ozone can be used to further facilitate separation of the particles by degrading and/or cleaning the coatings and residues left by reagents used in previous flotation stages. Additionally, longer ozonation time or ozone treatment oxidizes the mineral surface of more reactive substances, and it has been discovered that ozone oxidizes the surface of the iron sulfide minerals faster than the surface of the other more desired sulfide minerals.

Also, from an environmental viewpoint, iron sulfide is a source of sulfur dioxide at the smelter. Some countries have regulations requiring the reduction of sulfur dioxide emissions. Therefore, it is a further object to remove iron sulfide from the subject metals, thereby increasing the purity of the metals and decreasing the emission of sulfur dioxide during smelting.

BRIEF DESCRIPTION OF DRAWINGS

To understand the nature and objects of the present invention, reference should be had to the following detailed description, taken in conjunction with the accompanying drawings, in which:

FIG. 4 is an example of a simple flotation procedure;

FIG. 5 is an example of a rougher-scavenger-cleaner system;

FIG. 11 shows a table, illustrating the effect of ozone on sphalerite in the conditioning step;

FIG. 12 shows a chart showing the effect of ozone in zinc grade-recovery; and FIG. 13 shows a chart showing the effect of ozone in iron grade-recovery.

DESCRIPTION OF PREFERRED EMBODIMENTS

This invention is related to the separation of minerals by flotation. It provides a method to increase the grade or recovery of metals values such as zinc, copper and nickel by rejecting iron sulfides (pyrrhotite and pyrite) from the concentrate. Flotation is a selective process and can be used to achieve specific separations from complex ores such as lead-zinc, copper-zinc, pentlandite (nickel and iron) etc. While flotation was initially developed to treat the sulphides of copper, lead, and zinc, the field of flotation has now expanded to include the oxidized minerals and non-metallics, including fine coal, as it is an economically important process. As there are many aspects of flotation, the process can be improved and refined. Standard flotation tests, in which air was used in the conditioning and flotation steps, were compared with experiments using ozone in the conditioning step and nitrogen or air in flotation. The results indicate an increase from 1% to 5% in zinc grade while keeping similar zinc recovery and diminution of grade and recovery of iron in the concentrate by at least 2% and 5%, respectively. It is believed that similar enhanced recoveries of nickel and copper can also be achieved by this method.

The flotation process yields two main products the concentrate and the tailing. See FIG. 1. The concentrate contains the metal value such as copper, zinc, nickel, etc., while the tailing contains the gangue or undesired products or components which may also be considered to be wastes and/or less desirable products and/or desired products in a more impure state. The invention provides a novel method to increase the grade of metals values such as zinc, copper and nickel rejecting iron sulfides (pyrrhotite and pyrite) from the concentrate. As a further benefit, the reduced iron sulfide content decreases the emission of sulfur dioxide during smelting of the copper and nickel concentrates or during roasting of zinc concentrates, as well as decreasing the production of jarosite or goethite (or other forms of iron rejection) in the zinc leaching circuit.

Other chemical agents can be added to the slurry to assist in the separation process, such as depressants or modifiers. The presence of depressants generally assists in selectivity and/or stop unwanted minerals from floating. In contrast, modifiers facilitate collection of desired minerals, and include several classes of chemicals such as activators, alkalinity regulators, and dispersants. Activators are used to make the mineral particle surface amenable to collector coatings. Alkalinity regulators are used to control and adjust pH, an important factor in many flotation separations, while dispersants work to control slimes which can interfere with selectivity and increase reagent consumption.

Figure 1:
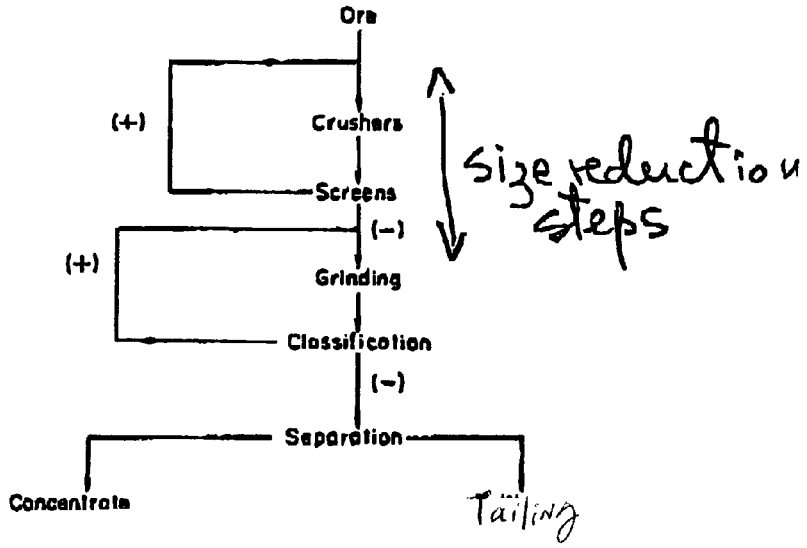
FIG. 1 is a flow chart showing the sequence of operations in a metallurgical plant.

FIG. 1 illustrates the sequence of operations in a typically metallurgical plant. First, ore is obtained and then crushers, screens, and grinding is used to reduce the size of the ore. Once ground, the ore is classified and then separated, for example by flotation. The ore that is to be separated primarily comprises zinc, copper and/or nickel ores along with iron sulfide ores, but may other minerals may also be separated by this process. The desired particle size of the feed varies depending upon the type and purities of ores used, and a variety of other factors including the flotation stage. In fact, the ore may even be further grinded in the middle of the flotation circuit to further reduce and/or homogenize the particle size. A preferred mean particle size comprises about 45 to 120 microns, but may also be larger or smaller as desired and may also range from about a 10 micron particle size to 250 microns or more.

Once the ore or other mineral particles have been reduced to a desired size such as by crushing and dry and/or wet grinding, the particles are placed in a flotation cell 2, then diluted by water such as 1:5, but especially in excess of 50% water to form a slurry 4. See e.g. FIGS. 2–3. The initial slurry or pulp contains less desirable iron sulfide mineral particles, gangue, and more desirable mineral particles containing mineral values such as zinc, nickel and/or copper, at least some of which are in sulfide form. The slurry may also contain a variety of reagents and compounds.

The slurry or moist ore is then agitated, such as by an agitator or impeller 10 and is pretreated and/or conditioned. During certain steps of the flotation process, reagents such as collectors are employed to change the physico-chemical surface properties of the hydrated particles. Other reagents or compounds known as frothers are used to yield bubble stability. Collectors are adsorbed on certain mineral particle surfaces producing a film or coating and water-repellent characteristics and as a consequence, the mineral is attached to an air bubble during aeration and agitation.

Depending upon the type of minerals present, a variety of collectors and reagents that are known to one skilled in the art and that are best suited for changing the flotation characteristics of the various minerals may be used during certain flotation stages. Many of these reagents may contain organic components and parts. The most widely used collectors for sulfide mineral flotation are the sulphydryl type such as xanthogenates, technically known as the xanthates, and the xanthogenates are the preferred collectors for use in this invention. They typically contain one to six carbon atoms and the most widely used xanthates comprise the ethyl, isopropyl, isobutyl, amyl, and hexyl xanthates. Other suitable collectors includes but are not limited to dithiophosphates, ethoxycarbonil, thionocarbonil, and other conditioning agents which contain organic components and are used in the presence of organic components known to one skilled in the art are also suitable for use.

In contrast, the frothers, which maintain froth stability, act in the liquid phase and do not influence the mineral surface. Frothers produce a froth 12 which is preferably just stable enough to facilitate the transfer of the floated material particles from the surface of the cell to the collecting launder. The frothing action is, in part, due to the ability of the frother to absorb on the air-water interface because of its surface activity and to stabilize the air bubble(s) due to the reduced surface tension. Most of the synthetic frothers are high molecular-weight alcohols, such as methyl isobutyl carbinol (MIBC). Another type of frother is based upon polyglycol ethers, marketed as Dowfroth® 250, Cyanamid R65™, and Union Carbide PG400™. Other suitable frothers known to one skilled in the art are also suitable for use. The desired concentration of the collectors and frothers reagent in the slurry may vary. The figures range from about 50 g to 500 g xanthate per ton or ore and around about 20 g MIBC per ton of ore.

Generally, collectors are used in small amounts, ideally forming a monomolecular layer on the particle surface. In contrast, an increased concentration is more costly, but more importantly tends to float other mineral particles and reduces selectively. An excessive concentration can also have an adverse effect on the recovery of valuable minerals. Importantly, it is more difficult to eliminate the coating and/or residues that have already absorbed on the particles that to prevent the absorption of collectors. It is also common to use more than one type of collector and/or frother, especially to increase the selectively during flotation. Other reagents used or known by one skilled in the art to enhance or facilitate flotation may also be added.

After the slurry 4 is formed, it undergoes a conditioning step where the slurry is mixed with reagents. The conditioning step also acts to prime the slurry before the flotation circuit. This step may take between about two minutes to ten minutes, or longer. In the flotation of sulfide ores, it has been found that the oxidizing environment in the slurry, which may be as measured by redox potential and/or dissolved oxygen concentration, has a significant influence on the flotation result. In fact, the presence of the oxidizing gas may even activate the surface of the sulfide mineral in the slurry, thereby making it more susceptible to bonding with a collector. The conditioned slurry is then fed to the flotation circuit, such as for example those shown in FIGS. 4 and 5, and the valuable minerals or more desired minerals are separated and recovered as a concentrate 50. The remainder of the slurry is rejected as tails 60. Flotation uses the differences in physico-chemical surface properties of particles to facilitate separation of the particles. The surfaces of some particles naturally reject water and are hydrophobic, while others have tendency to be "wetted," and are hydrophilic. Using this principle, flotation occurs when air bubbles 8 are present in flotation cells 2 or tanks. See e.g., FIGS. 2–3. As a consequence, mineral particles 14 that reject water will be attached to the bubble surface 9 and go to the top of the cell, and is called froth 12 or concentrate. The "wetted" minerals will remain in water at the bottom. In reality, however, not all the minerals behave as hydrophobic or hydrophilic particles. To produce mineral separation the mineral surface can be modified to be more hydrophilic or more hydrophobic. There are physical and chemical methods to achieve modification of the mineral surface.

Flotation reagents cause the desired mineral to be floated with a water-repellent coating that will easily adhere to an air bubble, which will raise the mineral through the slurry to the surface. See FIGS. 2–3. Froth is also generated by vigorous agitation and/or stirring such as by a rotating shaft and/or impeller 10, and aeration of the slurry in the presence of a frothing agent. The typical froth flotation stage takes about five to fifteen minutes. The desired mineral, which is separated and collected during the froth flotation process, is the concentrate, while other minerals and or particles such as gangue are hydrophilic and do not attach to the air bubble and sink due to gravity and form the tails. Thereafter, selected minerals are further separated from the concentrate and/or the tails.

After one or more flotation "cycles" with at least agitation and aeration, and at least one desired separation, the concentrate stream and/or tailings stream is then conditioned or treated with ozone. During experimentation, it was observed that after ozonation, froth was not formed during flotation, unless more frother was added. When ozone was added in the presence of certain collectors, such as xanthate dissolved in water, it was noted that xanthate disappeared and/or was altered so it was not measurable as a xanthate component in presence of ozone. It appears that initially ozone reacts with organics in solution and with organics adsorbed on the particle surfaces. Longer ozonation time oxidizes the mineral surface of more reactive substances. Ozone can be used to destroy xanthate, an organic compound, especially sulfonated organics in solution and/or to remove the xanthate coating and residues and/or other types of organic materials adsorbed on the sulfide minerals. This can be called cleaning.

It has been discovered that the use of ozone at selected stages will clean, destroy or otherwise alters these organic collectors and/or alters the properties of the organic collectors and frothers that are on the particle surface. As a result, the mineral particle has a fresh surface and a new chemical reagent can be added which is right for the next flotation step. Furthermore, weaker but more selective collectors may then be used after ozone treatment. This point is important since during flotation several collectors and other reagents are added at various stages, depending upon the needs of the process and the characteristics of the ore.

A relatively small amount of ozone can clean the particle surface by decomposing xanthate or other collectors adsorbed from a previous flotation stage. Further, ozone oxidizes the iron particles faster than the metal value particle in a previous step called conditioning. In this step, ozone will be injected in a reactor that could be a flotation cell for few minutes. Depending on the ozone dosage and the characteristics of the mineral, oxidation of sulfide minerals could occur producing elemental sulfur or hydroxides on the mineral surface or ionic oxy-sulfur species. Moreover, depending upon the duration of the ozone treatment, the concentration of the ozone gas used and the dosage in terms of kg $O_3$/ton ore to be treated, the surface of the mineral particles may be partially or even totally oxidized. This sequence can be used in flotation processing of zinc, copper and nickel, and is especially useful during stages where there is minimal separation between the desired ores and the iron sulfides and/or other less desirable ores and components. As a consequence, the iron content in the concentrate is decreased, and the grade of the metal value increases. By increasing the conditioning time, ozone also produces hydrophilic surfaces on certain minerals that were previously hydrophobic or somewhat hydrophobic which causes the ore particles to sink and/or resist flotation.

Figure 6:
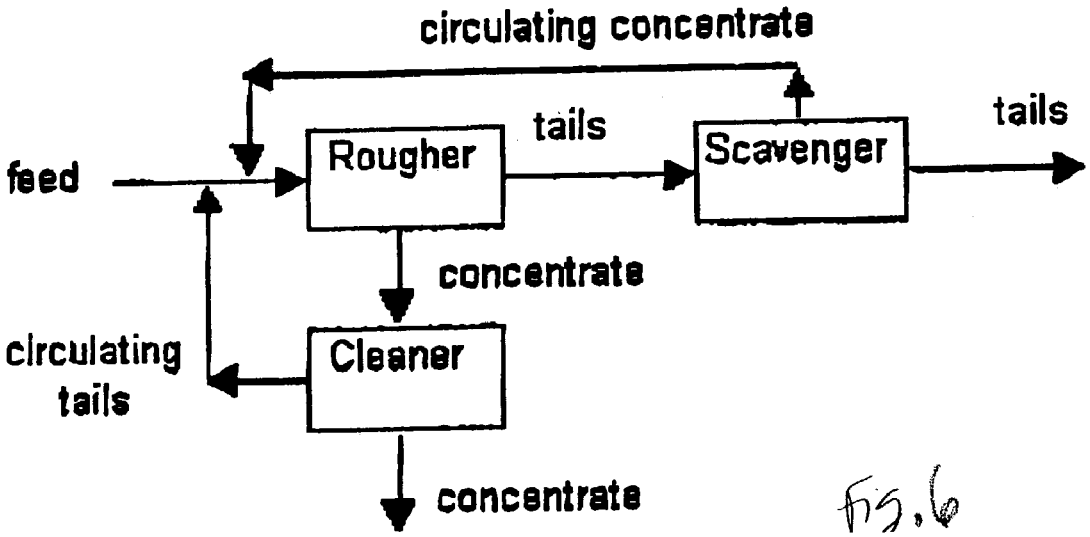
FIG. 6 is a flow chart depicting a separation procedure.

The addition of ozone to the slurry of ore and/or mineral particles can be carried out in a conventional mechanical flotation machine, as well as the other stages of the flotation process. The preferred equipment to dissolve ozone is a flotation cell; which enhances gas dispersion in the slurry and is easy to implement at industrial scale. However, equipment such as columns and other containers used by one skilled in the art may also be used in and during this process. In industrial plants there are several flotation cells, with sizes that typically vary from about 1 $m^3$ to about 100 $m^3$, and they are arranged in banks. Each bank may have varying and/or several functions, but the main goal is to typically efficiently separate concentrate from tailings. See e.g. FIGS. 4–5. The flotation process is known. FIG. 6 shows a circuit having two flotation cells, or a bank of cells in series, a rougher bank, and a scavenger bank. The concentrates from the first rougher flotation cell or bank of cells, is sent as a concentrates stream to a second cleaner/flotation cell, and is floated again. The cleaner concentrate has a higher grade of the desired minerals. The cleaner tails may be sent back to a rougher cell. The rougher tails also may undergo further separation in the scavenger cells. The scavenger's concentrates are circulated to the rougher feed while the scavenger's tail yields the final tail of the flotation circuit.

The slurry treated with ozone may be sent continuously or periodically to another flotation cell in which flotation reagents can be added. After approximately 5 minutes of reagents conditioning, the slurry is sent by gravity to another flotation cell in which air bubbles will be used to separate metal values from gangue (iron-sulfate and silicates). Typically, the residence time of the particles in the flotation cell is about 2 to 15 minutes, but can vary depending what grade-recovery of the metals is needed at that specific flotation stage upon the purity of the ore, pH, dissolved oxygen, and redox potential, and a variety of other factors. After flotation occurs at least once, and preferably more than once as shown in FIGS. 4–6 to obtain a more pure concentrate, with also less of the more desired minerals in the tailings, the slurry is then treated with ozone.

Figure 2:
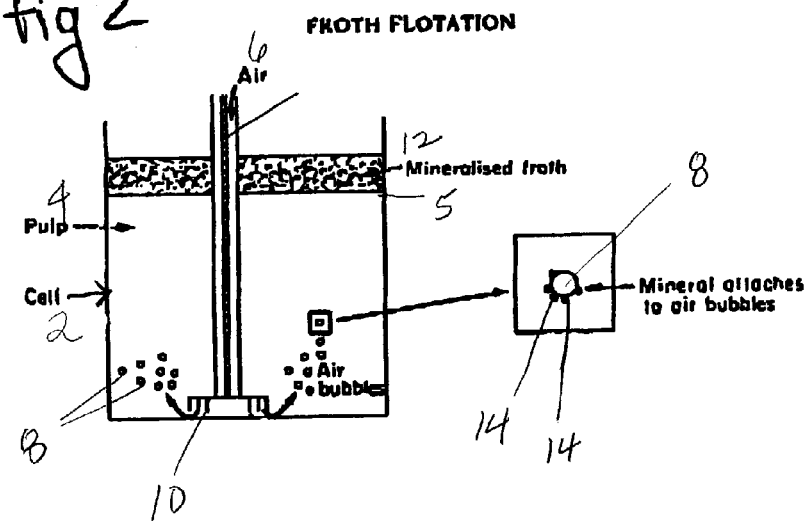
FIG. 2 depicts a froth flotation cell.
Figure 3:
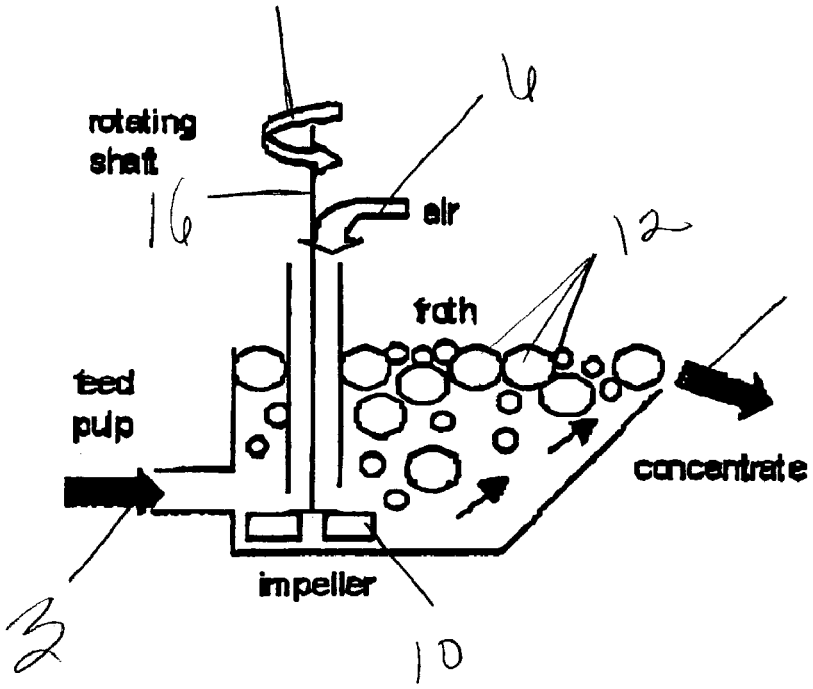
FIG. 3 depicts another embodiment of a froth flotation cell.
Figure 7:
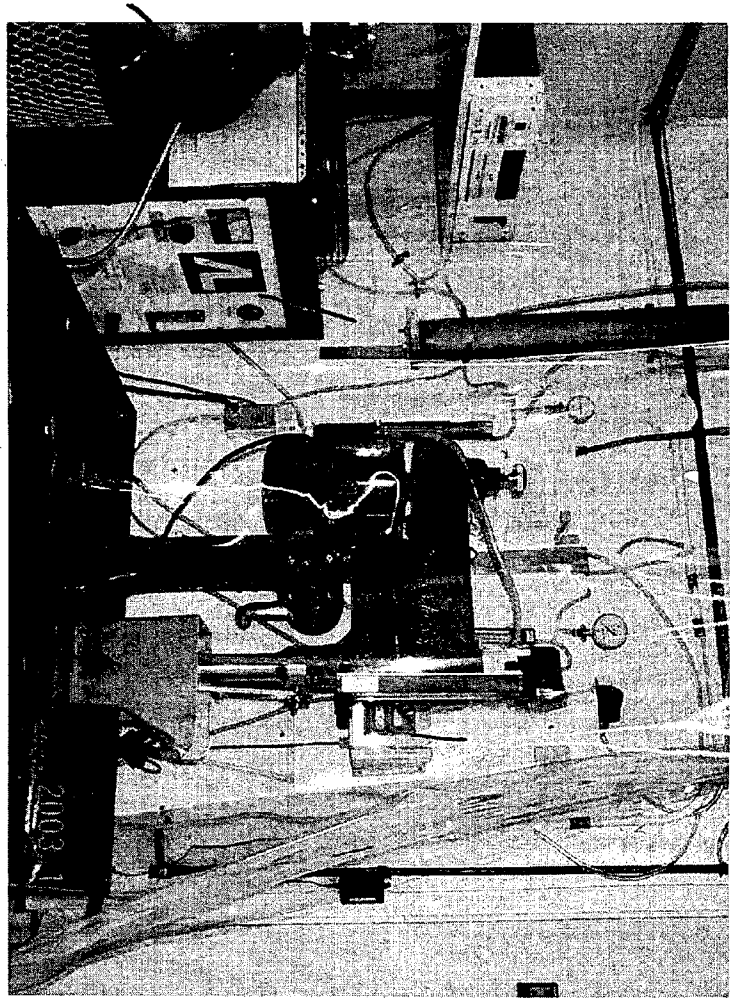
FIG. 7 is an example of apparatus used to conduct flotation experiments.

The reactor used for ozone injection can be the commonly known and used flotation machine. Although, the apparatus may vary under industrial conditions, the apparatus used during experimentation will be described and the processes described herein can be use in industrial and/or small-scale minerals separation. In this figure, the ozone injection point is on the external periphery of the disperser/impeller, see FIG. 8, however the ozone may be injected at other locations in the cell, preferably near the disperser. The agitation of the rotor divides the gas into small ozone-bubbles, which come into in contact with the sulfide particles. As shown in FIGS. 2–3, and 7, the cell for ozone treatment may comprise an open reactor, in which case any unused exiting ozone escapes into the atmosphere. There may also be means, which is known by one skilled in the art, for destroying unused ozone coming out of the reactor including but not limited to a heat source or heating means or a solid catalyst at room temperature.

Further, if desired, the ozone reactor may be a closed container or system for environmental purposes to minimize or eliminate the discharge of unused ozone. (Not shown). Also if a closed reactor is used, the non-reacted ozone can be collected and destroyed by using a catalyst to form oxygen, which can then be discharged into the atmosphere. If a closed system is used, the pressure is about 15 psig, which is the ozone generator pressure, but may be of other pressures. However, if properly regulated, dissolved ozone continuous measurements in the slurry pulp are about zero, since the ozone reacts to oxidize the iron sulfides or other minerals and ozone gas on the surface of the cell was lower than the environmental regulations (0.1 ppm). The ozone mass transfer from gas to liquid phase in a column was similar to the mechanical agitator reactor, but froth formation is significant.

Figure 8:
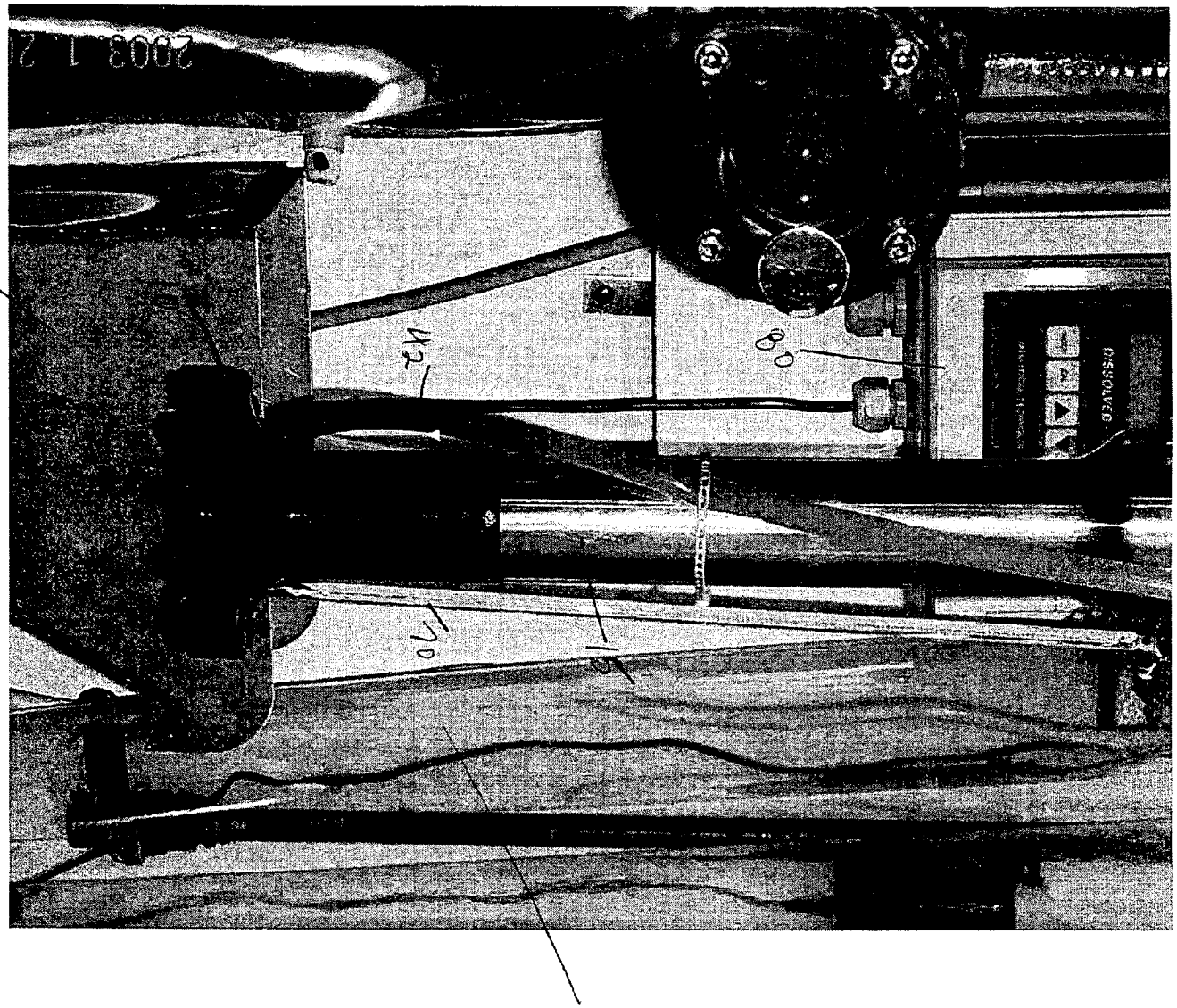
FIG. 8 is an example of apparatus used to conduct flotation experiments.

As shown in FIGS. 7–8, during testing, the ozone was supplied with an ozone generator, which is fed with a supply of oxygen. As shown in FIGS. 7–8, during testing, the ozone was supplied with an ozone generator, which is fed with a supply of oxygen, here a cylinder 40. Other sources of supply of oxygen known to one skilled in the art such as a, tank, line can also be used. Also, air can be fed into the ozone generator if a lesser concentration of ozone is desired. During the ozonation step or steps, ozone is preferably supplied instantaneously by using an ozone generator on site and pumping ozone as is needed. The ozone generator produces ozone by an electric discharge that breaks a molecule of oxygen in two atoms and causes the free oxygen atom to combine with another oxygen molecule to produce three oxygen atoms, or $O_3$ Dry air or dry oxygen is used as a gas source. Oxygen with a purity of at least about 70%–80% is preferably fed into the ozone generator since the use of oxygen yields a higher concentration of ozone concentration, such as to about 3.5%–15%, while feeding air into the ozone generator yields about 3.5–4.5% ozone. The higher ozone concentration produces higher ozone dissolution in water, which results in a more rapid oxidation of sulfide oxidation (order of minutes).

FIG. 8 shows the shaft 15 in the raised position, the rotor or impeller, and the flotation cell 2 at the back. The agitation of the shaft and/or rotor causes some mineral froth to overflow the cell, and enter another cell or collection means. After ozonation, air is injected through the shaft to perform the flotation.

Also there is preferably a thermometer 70 in this flotation cell, which may also be located near the shaft 15, adjacent to the shaft and/or slightly above the shaft. The thermometer may be at other locations within the cell as well. The desire temperature is typically about room temperature or about 25° C., but may be at other temperatures known or used by one skilled in the art. Also, as shown in FIG. 8, there is an analyzer 80 for at least analyzing the dissolved oxygen in the slurry, the ozone concentration in the outlet gas, the pH of the slurry, the dissolved oxygen concentration and the redox potential. There may also be other monitoring or analyzing apparatuses.

The copper value minerals involved in this invention are chalcopyrite, chalcosite, covellite, bornite and all related copper sulfide ores that are less reactive than iron sulfides. The main zinc sulfide tested in this invention was sphalerite but other zinc sulfide minerals, which are less reactive than iron sulfides can be applied. The main nickel sulfide mineral covered in this invention was pentlandite but other nickel sulfide minerals, which are less reactive than iron sulfides, can be used. The modification of the iron sulfide particles (pyrite and pyrrhotite) can be carried out in any flotation stage and/or in multiple flotation stages. The unit consumption of ozone decreases as the sulfur in the ore decreases. In the rougher stage the consumption ranges between 2 to 4 kg $O_3$/ton ore to be treated. If the cleaner concentrate, which represents around 20% of the total mass in the flotation circuit, is the feed for ozonation, the ozone consumption reduces to around 0.5 kg/ton of cleaner concentrate. Depending on the minerals, the ozone could be used in one step, for example the rougher concentrate 52 in FIG. 5, or in several points of circuits. At the end it will depend on the economics of the process. If the dose of ozone kg/min is less, the ozone conditioning may take up to 30 minutes or more than 60 minutes, depending upon the concentration of the ozone and the gas flow rate is used. However, as the treatment time is lengthened, it becomes less economical.

Therefore oxygen instead of air as a feed gas is preferable.

Once the slurry, tailings, and/or concentrate has undergone ozone treatment at least one new collector and/or at least one new frother and other required flotation reagents, such as copper sulfate to activate zinc flotation treatment to refloat the floatable particles with air. It is believed that the ozone destroys or otherwise alters these organic collectors and/or alters the properties of the organic collectors, which are dissolved in water and/or adsorbed on the surface of the particle. These additives, such as collectors, often cause the mineral particles to adsorb the reagents on their surface, which are not desired and/or needed in the next flotation step. The destruction of certain flotation and collector reagents used in prior flotation stages is especially advantageous since it seems that the collector added near the head of the flotation system is normally relatively strong and non-selective to promote maximum recovery, while a weaker but more selective collector is often added to the primary concentrate to upgrade the final concentrate produced, further down in the process.

The flotation of sulfide minerals is performed in alkaline conditions, between pH 8 to 12. The pH range in the experiments was from 9 to 11.5. Additionally, the oxidation reduction potential may also be measured. The oxidation reduction potential (ORP) depends upon the pH. In tests, for example, a slurry sample at pH 6.5 had an ORP of 532 mV (also known as the standard hydrogen electrode or "SHE").

In contrast, the same sample at pH 11 had an ORP of 290 mV (SHE). The potential decreases approximately 60 mV per each pH unit of increase. This pH-potential relationship could vary due to the galvanic interactions between sulfide minerals and some by-products ions, which can modify the solution potential.

Yet, during ozonation, the ORP increased only 5 mV. However as time progressed, an increase of potential was observed due to the partial oxidation of the sulfide minerals. In fact, there may ultimately be an increase up to 100 mV or more, compared to the initial values. This increment could be due to the increase of dissolved oxygen, around 35 mg/l. The use and/or demand for ozone that is sent into the system and/or leaves the system and is unused can be measured. During the ozone treatment phase or phases, a variety of parameters can be measured, such as pH, redox potential, dissolved oxygen and dissolved ozone. Because pH is important, it is preferable to keep the pH constant. The Redox potential depends upon the pH and measures the average potential in the slurry but not the potential at the interface. Dissolved oxygen can also be considered before adding xanthate. At optimal efficiency, little to no residual ozone is detected in solution as the sulfide ore immediately consumes most if not all of the dissolved ozone.

Additionally, the ozone levels in the slurry and on the surface can be monitored during ozone treatment, such as at the outlet. During the experiments, it was also noticed that there was no ozone smell on the surface, of the flotation machine (the human nose can detect very low concentration of ozone, 0.01 to 0.05 ppm). Further, this observation was confirmed using an ozone detector for environment (detection range 0.001 to 0.1 ppm). As a consequence, in the range of rate of ozone used in these experiments (0.2 to around 1.5 g/kg ore), ozone was completely used in the process.

Regarding the control of ozone use during processing, the quantity of ozone per unit time that is or was injected into the flotation machine can be used to make a mass balance to get the unit consumption (g ozone/kg ore). As such, specific conditions can be maintained for pretreatment experiments and/or during the ozone conditioning phase. For real time or near real time conditions, the ozone gas analyzer is located near at the top of the ozone generator and/or top of the slurry and/or froth. Alternatively, the ozone gas analyzer may be located away from the reactor cell with a probe extending from the gas analyzer. The laboratory flotation machine has a rotor, paddle, impeller 10 or other stirring or agitating means, such as a movable arm that can be raised or lowered on a shaft to enter the flotation cell and/or during stirring or agitation, and is used to disperse the ozone gas bubbles. See e.g. FIGS. 2, 3 and 8. The rotation speed of the rotor or other stirring or agitating means may vary, but is preferably at about 500 to 3000 rpm, but may be less vigorous such as more or less than 200 rpm if the impeller device can assure adequate gas dispersion, i.e., production of fine bubbles. The rate of agitation is also an important consideration since dissolution of ozone is faster as agitation is increased. Agitation breaks the gas bubbles and produces higher surface area, which is proportional to pumping more ozone in water.

During flotation, the mineral slurry is added in the cell and air or other gas is preferably introduced through the shaft, but may also be introduced by a line that has an opening near the bottom of the flotation cell and/or near the shaft, such as a Tygon tube that is used to inject ozone. The tubing 42 preferably ends close to the rotor or impeller 10 in order to break up the ozone bubbles ensuring maximum dispersion of the gas and to increase the efficiency of ozone.

There may also be a thermometer in the flotation cell, which may also be located near the shaft, adjacent to the shaft and/or slightly above the shaft. The desire temperature is typically about room temperature or about 25° C., but may be at other temperatures known or used by one skilled in the art.

For rejecting pyrite and pyrrhotite and increasing the grade of the metal value by using ozone, ozone can be used in at least two main stages, ozone conditioning followed by the addition of flotation reagents and froth flotation. First, ozone is used to destroy the collector on the particle surface and/or other flotation organic reagents that are dissolved in water or adsorbed on the particle surface. In some mineral processing circuits, the selective separation of minerals needs to clean the reagents adsorbed on the mineral surfaces and/or dissolved in water, which were added in a previous flotation step. To clean the mineral surfaces by destroying the flotation reagents, ozone is used as an effective oxidant. After ozonation, new flotation reagents specific for the desired mineral separation can be employed more effectively. For example, to get a differential concentration, for example, of three minerals contained in a bulk concentrate, use of new flotation reagents (collectors, depressor, frothers, etc.) must be used in this step. To do that, the surface of the mineral particles must be cleaned as well as the liquids in the slurry containing the previous reagents. In this application, ozone removes the reagents adsorbed on the surface particle and destroys the flotation reagents dissolved in water.

Second, ozone acts on the flotation of mineral particles by modifying the chemical composition of the surface of the sulfide particle. Longer ozone contact time will oxidize the sulfur and the metals of the sulfide particle. Some reaction products will dissolve in water, such as, polysulfide and metallic ions and some can remain on the mineral surface such as elemental sulfur or thiosalts, which are hydrophobic species. Due to the high pH of most of the flotation processes, precipitation of metallic ions as hydroxides cause hydrophilic areas on the mineral particle. Importantly, ozone appears to acts differently than oxygen. For example, pyrrhotite and chalcopyirite float without collectors due to the sulfur species formation on their surfaces in presence of oxygen. However, in the case of ozone, the depression of pyrrhotite was observed indicating that the new substances on the surface must be hydrophilic. Pyrite is not easily oxidized by oxygen, but in presence of ozone it was depressed. As a consequence, ozone can create hydrophobic substances on some mineral particles, producing hydrophilic compounds, while in more inert sulfide particles a negligible oxidation occurs.

After the flotation is completed, the separated mineral particles may be further treated and/or processed as known by one skilled in the art. As a further benefit of the foregoing processes, the reduced iron sulfide content decreases the emission of sulfur dioxide during smelting of copper and nickel concentrates or during roasting of zinc concentrates, as well as decreasing the production of jarosite or goethite (or other forms of iron rejection) in the zinc leaching circuit.

EXAMPLES

Nickel Separation

Some nickel mills have a circuit, which is part of the overall circuit and it is fed by streams that are low in nickel content. The main goal of this circuit is to recover as much as possible pentlandite (Fe, Ni) 9S8, by rejecting iron sulfide (pyrite or/and pyrrhotite).

In one plant, a surface analysis using the Scanning Electron Microscopy, SEM, was carried out indicating that 90% of the pyrrhotite (Po) and 80% of the pentlandite (Pn) was liberated in the 10 to 40 micron size range.

Figure 9:
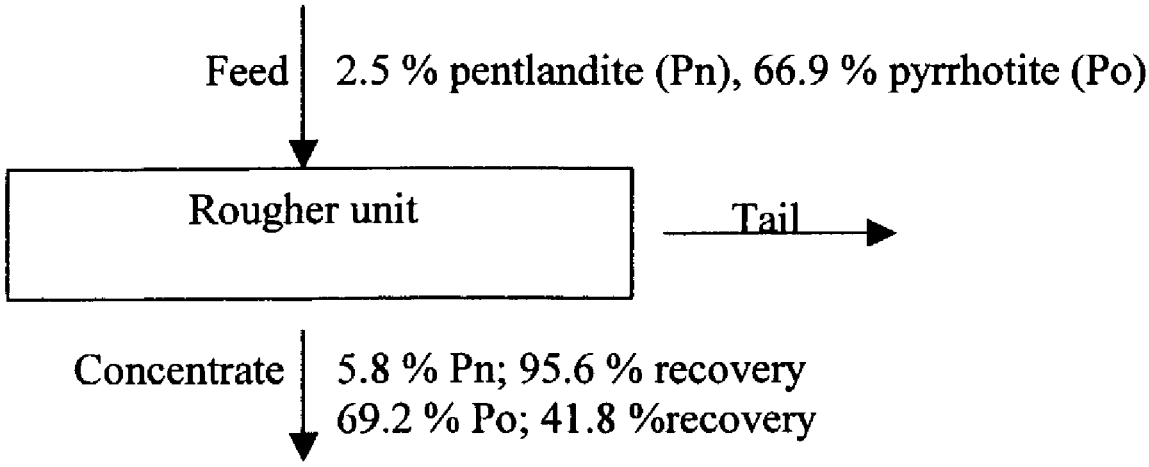
FIG. 9 illustrates a mass balance of a baseline for nickel separation.

The effect of ozone was evaluated theoretically under the following assumptions: Ozone will oxidize 70% of the liberated pyrrhotite before significant oxidation is detected on the liberated pentlandite. FIG. 9 illustrates a mass balance of the baseline situation (no ozone injection) in the rougher unit. The nickel and iron recovery is 95.6% and 41.8%, respectively. The pentlandite (nickel mineral) grade increased from 2.5% in the feed to 5.8% in the concentrate, while pyrrhotite went up to 69.2% from 66.9%.

Figure 10:
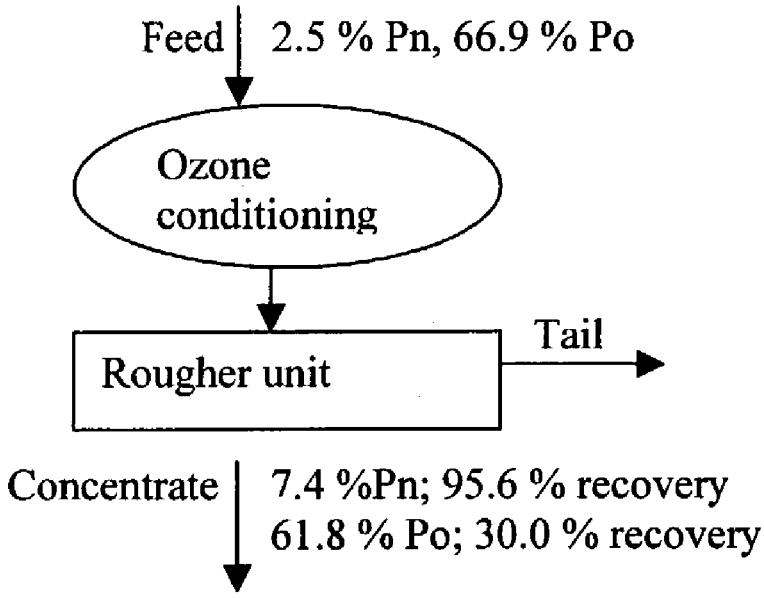
FIG. 10 shows the estimated mass balance using ozone in the conditioning step.

FIG. 10 shows the estimated mass balance in the rougher unit using ozone in the conditioning step. There is a significant diminution of pyrrhotite in the concentrate (30% compared to 41.8% in the baseline situation). In terms of grade, the pentlandite increases to 7.4% from 5.8% and pyrrhotite decreased to 61.8% from 69.2% referred to the baseline figures.

TEST EXAMPLES

Zinc Separation

A final cleaner zinc concentrate from a Canadian mill (54.5% Zn and 8.5% Fe) was employed to evaluate the effect of ozone in the conditioning step. See FIG. 11. To one skilled in the art, choosing the product of the mill, such as this sample, it is difficult to improve grade or recovery. The idea choosing this sample was to evaluate ozone in the worst-case scenario. Tests 1 and 2 shown in FIG. 11 are the baseline flotation experiments. Test 1 was performed without adding any flotation reagents. After 10 minutes flotation time, the grade of zinc and iron were 58.0% and 7.7%, respectively, while the zinc and iron recovery were 78.5% and 67.7%, respectively. In test 2, xanthate and a frother were added prior to flotation. The zinc and iron grade were similar to the original sample. In terms of recovery, it was close to 100% for zinc and iron, thus indicating there was virtually no room for improving the process by using additional flotation reagents in this flotation step. In test 3, nitrogen was used instead of air, and the same dose of flotation reagents from test 2 were used, and resulted in similar grade and recovery. Tests 4 to 11, show the effect of ozone in the conditioning stage. As a general observation when ozone was used in conditioning followed by flotation, there was no froth formation and no concentrate was obtained. As a consequence it was necessary to add a new dose of collector and frother prior to flotation and after using ozone to produce metal separation by flotation. For a low ozone dose (duplicated tests 4 and 5) the zinc and iron grade is 57.5% and 7.5%, respectively. After using ozone conditioning, zinc recovery increased 1.5% to 80.7% in comparison to baseline test 1. Also, more iron, 1.5%, was recovered in the ozonated sample than test 1. It seems that at the ozone dose of 0.26 kg $O_3$/ton feed concentrate, the flotation reagents in solution degraded and that the reagents adsorbed on the surface were affected, but the surface of the mineral particles was unaffected. When fresh or new flotation reagents were added after ozonation, but prior to flotation, the xanthate was adsorbed with no selectivity on the zinc and sulfide particles. However, after almost doubling the ozone to 0.40 kg/$O_3$ and keeping the same concentration of the flotation reagents, the iron grade decreases to 6.9 compared to 7.7 of the baseline test, and the recovery was poor for zinc and iron, 48.5% and 36.7%, respectively. In test 6, the dose of xanthate was increased to 60 g/ton after the ozonation step. The results indicate an increase in zinc recovery to 72.5% from the starting 58% zinc concentration. The iron grade in the concentrate was 6.9%, which is 0.8% less compared to the baseline test with a significant decrease in iron recovery to 58.2%, as compared to the 67.7% in baseline test 1. Based upon these results, a larger ozone dose not only destroyed the xanthate but also oxidizes the iron sulfide particles. As a consequence to get acceptable recoveries, xanthate must be removed prior to flotation. To activate sphalerite flotation, copper sulfate (20 g/ton) was added after ozonation. For test 8 using low ozone levels, 0.26 kg/ton concentrate, the zinc and iron recovery increased significantly by 10 points compared to baseline test 2 and the grades were similar. When increasing the ozone dose to 0.52 kg/ton concentrate (test 9), the zinc and iron recovery decreased as well as the iron grade. Test 10 was run at the same conditions of test 9, except the copper dose was increased to 50 g/ton instead of 20 g/ton. The ozone dose was also increased to 0.78 kg/ton with 50 g copper/ton. For both tests the recovery of zinc is much lower than the baseline test, while iron recovery decreased up to 22 points. It seems that a high copper dose reacts with xanthate in solution instead of reacting on the surface particle. Even if the rejection of iron in the concentrate is significantly lower than the baseline test, in practice it would be difficult to have an additional flotation step with only 60% zinc recovery. Based upon these results, an ozone dose of 0.26 kg/ton of feed concentrates in presence of 20 kg/ton yields a higher recovery of zinc and a significant rejection of iron in the concentrate.

FIGS. 12 and 13, below, clearly show the effect of ozone to increase zinc grade rejecting iron sulfides from the zinc concentrate. The sample was a rougher concentrate, which feed the cleaner circuit (27.1% Zn, 20.64% Fe, 2.0% Pb and 0.43% Cu). The baseline tests (4, 8 and 20) yield an average zinc grade-recovery of 27% and 70%, respectively. The cumulative grade-recovery for iron was 23% and 68%, respectively. Ozonated samples systematically produced a better quality in the zinc concentrate. Depending upon the ozone dose, the iron grade in the concentrate decreased from the initial 20.64% up to 17%, while the iron recovery drastically decreased to 50% compared to 70% when ozone was not used. In terms of zinc in the concentrate, the grade increased up to 35%, which represents an increment of 30% of feed, while the zinc recovery remained constant.

It has been discovered that ozone can be used to reject iron sulfide (pyrite and pyrrhotite) in metals such as, copper, zinc and nickel by oxidizing preferentially iron sulfide more than sulfide minerals containing metal values.

Also, under proper conditions, ozone can be used to reject iron sulfide in the zinc concentrate by preferentially oxidation of iron sulfide particles (pyrite and pyrrhotite) than zinc sulfide minerals (sphalerite).

EXAMPLES

Copper Separation

In copper circuits, low grades are often the result of iron sulfide gangue minerals mixing into to the concentrate. The effect of ozone gas conditioning was estimated using a sample with 2% chalcopyrite, 19% pyrite, 61% pyrrhotite and the balance were non-sulfide gangue minerals. The pH was chosen at 8.5 rather than high pH, such as pH 11, in order to avoid the preferential formation of surface oxidation products on pyrite and pyrrhotite rather than on chalcopyrite due to the increase in pH. The copper and iron recovery for a baseline test were 85% and 28%, respectively. When ozone was used in the range of 2 to 4 kg $O_3$/ton feed material, the recovery of copper increased to 90% and iron recovery decreased to 25%. Since the difference in copper recovery is relatively higher than iron, the oxidant not only affected the surface particles but also the state of the collectors, which increased the flotation rate constant of copper. It appears that the electrochemical reaction between the collector and the chalcopyrite surface may be more rapid and/or stronger than the reaction rate of collector/iron sulfide.

There are a variety of processes contemplated by this invention. Once such process contemplates a method of separating iron sulfide mineral particles from other mineral sulfide value particles containing zinc, nickel and/or copper by using ozone during certain flotation steps to at least degrade the frothers and collectors in the slurry liquid and/or remove the collectors adsorbed on the surface of the particles. First a slurry is obtained that is comprised of less desirable iron sulfide mineral particles and more desirable mineral sulfide particles containing mineral values of zinc, nickel and/or copper, wherein the particles are of a preferred particle size. The pH is then adjusted and/or maintained within the slurry to a desired level between about pH 8.0 and pH 12 at least one time. A collected is then added to the slurry that adsorbs on at least a portion of the particles and at least one frother is added to the slurry. The slurry is then conditioned slurry during and/or after the collector is added with at least air to obtain flotation conditions for at least some of the particles. Also in an embodiment, the slurry may be conditioned with a base for a time period of at least about 2 minutes to about 30 minutes, before flotation.

A flotation concentrate stream and a flotation tailings stream are then obtained, wherein the concentrate stream comprises the more desirable mineral sulfide value particles and wherein the tailings stream comprises the less desirable iron sulfide particles. After at least one flotation process, and perhaps several, the concentrate stream and/or the tailings stream with at least about 3.5%–15% ozone for a time and/or concentration sufficient to at least degrade the frother and collector in the liquid phase and/or to remove the collectors adsorbed on the surface of the particles. As a continuous or additional process the concentrate stream and/or the tailings stream is further treated or supplied with at least about 3.5%–15% ozone for a time and/or concentration sufficient to oxidize the surface of iron sulfide minerals faster than the surface of the other more desired sulfide minerals. During ozone treatment, the surface of the iron sulfide minerals may be partially and/or totally oxidized during step. The concentrate and/or tailings stream is then agitated during at least step the ozone treatment. If further separation of the more desired mineral sulfide particles from the less desired iron sulfate particles in the concentrate and/or tailings stream is desired, at least one new collector and/or at least one new frother is added after ozone treatment to refloat the floatable particles with air. Also, any other required or desired flotation reagents may also be added to refloat the floatable particles with air and/or optimize recovery. For example, copper sulfate may be added in presence of zinc, thereby enhancing the recovery of zinc. Next at least one flotation concentrate stream and at least one flotation tailings stream is obtained, wherein the concentrate stream comprises the more desirable mineral sulfide value particles and wherein the tailings stream comprises the less desirable iron sulfide particles. The tailings and/or the concentrate may be subjected to the foregoing conditioning, treatment, and separation steps at least once.

The process may be conducted on a batch or continuous basis. It may also be used for differential or bulk flotation applications.

During this process, the slurry and/or streams may be agitated. The agitation also serves to adequately disperse the ozone gas during ozone treatment. In an embodiment, the concentrate and/or tailings stream are agitated at about 200 rpm to 3000 rpm.

A variety of collectors known or used by one skilled in the art may be used. In an embodiment, at least one collector is selected from the group comprising a sulphydryl, a collector having a carbon chain length comprising about 1 to 6 carbon atoms, a xanthogenate, and/or a dithiophosphate.

The ozone may be provided by an ozone generator fed with oxygen or dry air.

The ozone may be used for a time period of at least about 2 minutes to about 30 minutes or longer, depending upon the concentration of the ozone. In an embodiment, the ozone generator is fed with oxygen and the concentrate stream and/or the tailings stream is treated with at least about 3.5%–15% ozone for about at least about 5 to 25 minutes during the step when the collectors and/or frothers are degraded and the surfaces of the particles are cleaned, as well as in the step when the surfaces of the particles are oxidized with ozone. Also in an embodiment, the ozone generator is fed with oxygen and the concentrate stream and/or the tailings stream may be treated with at least about 8%–15% ozone for about at least about 5 to 15 minutes in each or both of the foregoing steps, depending upon the concentration of the ozone. In an embodiment, the ozone generator is fed with oxygen and the ozone in each and/or both steps preferably comprises about at least about 10%–14% ozone. In another embodiment, the ozone generator is fed with air and the concentrate stream and/or the tailings stream is treated with at least about 3.5%–4.5% ozone for about at least about 5 to 60 minutes in each step and/or both steps.

Also in an embodiment, the concentrate stream and/or the tailings stream consumes may about between about 0.25 to 4.0 kg ozone/treated ton of particles during each and/or both of the foregoing steps, depending upon the sulfur content in the ore and degree of oxidation.

The preferred particle size may comprise particles having a mean particle size of about 45 to 120 microns, and/or the preferred particle size may comprise particles substantially of about 20 to 250 microns. The particles may be further and/or initially ground to achieve this particle size during this process.

In this method, the pH preferably comprises about pH 8 to pH 12, and wherein the potential referred to the standard hydrogen electrode of the slurry and/or concentrate stream or tailings stream is between 450 mV and 230 mV, respectively. Additionally, the oxidation-reduction potential is raised to a level from about +5 millivolts to about 100 millivolts greater than the initial oxidation-reduction potential of the slurry during and/or after ozone treatment, depending upon the oxidation state of the sulfide minerals.

In this method, a variety of frothers known to one skilled in the art may be used. In an embodiment, the at least one frother is selected from the group comprising high molecular-weight alcohols, methyl isobutyl carbinol (MIBC), polyglycol ethers, Dowfroth® 250, Cyanamid R65™, Union Carbide PG400™, or a combination of the foregoing. In an embodiment, the collector comprises a xanthogenate and wherein the frother comprises MIBC.

As a further feature of the method pH and/or redox potential may be measured in real or nearly real time.

Further dissolved ozone and dissolved oxygen in the concentrate and/or tailings stream may be measured during and after ozone treatment in real or nearly real time. Nearly real time comprises delays in obtaining the data due to complicated analysis and/or readings that may taken a periodic intervals within seconds or minutes of one another to give nearly real time data. Also temperature may be measure at selected or all stages of the process. Further, the particle size of the feed, slurry, or streams may be measure real or nearly real time by an apparatus used or known by one skilled in the art for measuring particle size.

In an embodiment, a closed or covered reactor or cell may be used, especially during ozone treatment. Additionally when the reactor or cell is closed, gas that exits from the tailings stream and/or concentrate stream may be collected. Also, the collected gas may be monitored. Any ozone in the exiting gas may also be monitored in real or nearly real time. In the process, any ozone in the gas phase exiting the conditioning reactor or cell may be destroyed using heat and/or a solid catalyst at room temperature.

In an embodiment, the method may be operated at temperatures up to about 100°, but may also be operated at ambient and/or room temperature.

Additionally, the method may be operated at ambient pressure. However, in the embodiment where the cell or reactor is closed at least during ozone treatment, the method may be operated at a pressure of about up to 15 psig, and in some cases higher pressures.

The desired pH may vary depending upon the stage of separation, type of minerals being separated, and/or types of collectors and other flotation reagents. In an embodiment, the desired pH is about pH 8 to pH 11, and copper recovery is enhanced by this process by at least about 2% to at least about 5%. As a further result of this process, the iron sulfide content in the copper may be is decreased by up to about 3%.

With respect to the recovery of other mineral values, the recovery of the zinc is enhanced by this process by at least about 5% to at least about 10%, and iron sulfide content is decreased by up to about 5%, especially when copper sulfate is added in the presence of zinc. Otherwise, the zinc grade can be increased up to 5%, and wherein iron grade can be decreased up to about 5%.

In this method, the recovery of the nickel may be about constant but the iron recovery in the concentrate is decreased up to about 10 points. In this method, the grade of nickel increases about 1% and wherein iron decreases about 8%.

In another aspect of the invention, the method for separating ore material comprising gangue, iron sulfide minerals, and other minerals containing mineral values of at least zinc, nickel and/or copper at least some of which are in sulfide form, comprises obtaining ore particles of a preferred size and/or grounding ore materials to a preferred particle size; forming a slurry comprised of at least water, less desirable iron sulfide mineral particles, gangue, and more desirable mineral particles containing mineral values of zinc, nickel and/or copper, at least some of which are in sulfide form; adjusting and/or maintaining the pH of the slurry to a desired level between about pH 8.0 and pH 12 at least one time; adding at least one collector to the slurry and/or at least one frother to the slurry; raising and/or maintaining the potential of the slurry to a level sufficient for the collector to adsorb onto at least the sulfide particles; conditioning the slurry with at least air to obtain flotation conditions for at least some of the particles; obtaining a flotation concentrate stream and a flotation tailings stream, wherein the concentrate stream comprises the more desirable mineral particles and wherein the tailings stream comprises the less desirable iron sulfide particles and gangue; treating the concentrate stream and/or the tailings stream with at least about 3.5%–15% ozone for a time and/or concentration sufficient to at least degrade the frother and collector in the liquid phase and/or to remove the collectors adsorbed on the surface of the particles; agitating the concentrate and/or tailings stream during at the ozone treatment; and further separating the more desired mineral particles from the less desired iron particles in the concentrate and/or tailings stream. The tailings stream and/or concentrate stream may also further undergo the foregoing process at least once.

This method may be used in a bulk and/or differential flotation.

In an aspect of the method at least one new collector and/or at least one new frother may be added after ozone treatment to refloat the floatable particles with air, and then at least one flotation concentrate stream and at least one flotation tailings stream is obtained, wherein the concentrate stream comprises the more desirable mineral particles, some of which are sulfides, and wherein the tailings stream comprises the less desirable iron particles, some of which are sulfides. As a further aspect, any other required flotation reagents may be added after ozone treatment to refloat the floatable particles with air and/or to enhance recovery of the more desirable minerals.

In an aspect of the process, the concentrate stream and/or the tailings stream may be treated with at least about 3.5%–15% ozone for a time and/or concentration sufficient to oxidize the surface of the iron sulfide minerals faster than surface of the other more desired sulfide minerals, while agitating the concentrate and/or tailings stream during oxidation. After the ozone treatment, if desired at least one new collector and/or at least one new frother and any other flotation reagents required after ozone treatment to refloat the floatable particles with air may be added and the more desired mineral sulfide particles from the less desired iron sulfate particles in the concentrate and/or tailings stream.

During this process, the concentrate stream or tailings stream may be agitated during ozone treatment at about 200 rpm to 3000 rpm.

At least one collector is used to assist in flotation. A variety of collectors known to one skilled in the art may be used. In an aspect of the invention, the collector is selected from the group comprising a sulphydryl, a xanthogenate, a dithiophosphate or a combination thereof. Further a collector that has a carbon chain length comprising about 1 to 6 carbon atoms may be used. Also, at least one frother is used to assist in flotation. A variety of frothing agents that are known to one skilled in the art may be used. In an aspect of the invention, at least one frother is comprised of high molecular-weight alcohols, methyl isobutyl carbinol (MIBC), polyglycol ethers, Dowfroth® 250, Cyanamid R65™, Union Carbide PG400™, or a combination of the foregoing.

During the ozone treatment, the surface of the iron sulfide minerals is partially and/or totally oxidized by the ozone treatment. The ozone may be provided by an ozone generator fed with oxygen or dry air. In an aspect of the invention, the concentrate stream and/or tailings stream consumes between about 0.25 to 4.0 kg ozone/treated ton. In another aspect, the concentrate stream and/or tailings stream is conditioned for about 3 minutes to about 30 minutes with about at least about 3.5–15% ozone, depending upon ozone concentration. In a further aspect, the concentrate stream and/or tailings stream is conditioned for at least about 3 minutes to about 30 minutes with about at least about 10–13% ozone, depending on ozone concentration.

The preferred particle size may comprise particles wherein the majority of the particles are about 75–150 microns in size. In this method, the pH preferably comprises about pH 9 to pH 12. Further in an aspect of the invention, the potential referred to as the standard hydrogen electrode of the slurry and/or concentrate stream or tailings stream is between about 450 mV and 230 mV, respectively. In an aspect of the process, the added ozone increases the oxidation-reduction potential at least about +5 millivolts to about 100 millivolts greater than the initial reduction potential of the slurry, depending upon the oxidation state of the sulfide minerals.

During this process, one of more of the following parameters comprising pH, ozone saturation, oxygen saturation, redox potential, slurry temperature, particle size, or a combination of the foregoing may be measured in real or nearly real time.

In an embodiment, the concentrate stream or tailings stream is in the cell or reactor may be covered and/or enclosed during ozone treatment, and possibly other stages of the process.

In yet a further method contemplated by this invention, iron sulfide mineral particles may be separate from other mineral sulfide value particles comprising at least zinc, nickel and/or copper by using ozone during certain flotation steps, and comprises obtaining a slurry which has already undergone at least one flotation step and has been conditioned with at least collector and/or frother and which comprises less desirable iron sulfide particles and other more desirable mineral particles, some of which are sulfides; supplying at least about 3.5%–15% ozone gas to the slurry for sufficient time to degrade the frothers and collectors in the slurry liquid and for a time sufficient to oxidize the surface of the iron sulfide minerals faster than the surface of the other more desired sulfide minerals; agitating the slurry during step (b) at about 200 rpm to 3000 rpm; adding at least one fresh collector and at least one fresh frother; refloating the floatable particles with air; and further separating the more desired particles from the less desired iron sulfate particles in the slurry. Also to facilitate flotation, any other required flotation reagents to cause flotation and/or enhance recovery of the more desired sulfide minerals after ozone treatment. In this method, the particles may be further separated by forming at least two portions in the slurry, wherein at least one portion comprises a concentrate of the more desired mineral sulfide particles and wherein at least one other portion comprises tailings of less desired iron sulfide particles.

During this method, the pH of the slurry may be adjusted and/or maintained at a desired level between about pH 2.0 and pH 12 at least one time.

Depending upon the duration of the ozone treatment as well as the concentration of the ozone, the ozone also removes the collectors adsorbed on the surface of the particles and enables the partial or complete oxidation of the surface at least the iron sulfide minerals. The ozone may be provided by an ozone generator fed with oxygen and/or dry air. In an aspect of the invention, the ozone generator is fed with oxygen and the slurry is treated with at least about 3.5%–9% ozone for at least about 5 to 25 minutes in step (b), depending upon the concentration of the ozone. Where the ozone generator is fed with oxygen and the slurry is treated with at least about 9%–15% ozone for at least about 5 to 15 minutes, depending upon the concentration of the ozone. Alternatively, where the ozone generator is fed with oxygen and the ozone preferably comprises at least about 10%–13% ozone. As a further alternative, where the ozone generator is fed with air, the slurry may be treated with at least about 3.5%–4.5% ozone, likely for a longer duration such as for about at least about 5 to 60 minutes or longer, even to about 120 minutes, if necessary.

In this method, the concentrate stream and/or the tailings stream may consume about between about 0.25 to 4.0 kg ozone/treated ton of particles during step, depending upon the sulfur content in the ore and degree of oxidation.

During this method, the pH may comprise about pH 8 to pH 12, depending upon the stage of separation, treated minerals, and/or collectors and other flotation reagents. Also, the slurry may be conditioned for about at least 5 minutes to about 15 minutes, or longer with a base.

The particles in the slurry may be comprised of particles substantially of about 20–250 microns in size, and may undergo further grounding to achieve this particle size.

When the pH comprises about pH 8 to pH 12, and wherein the potential referred to the standard hydrogen electrode of the slurry and/or concentrate stream or tailings stream is between 450 mV and 230 mV, respectively. Further, the added ozone may increase the oxidation-reduction potential at least about +5 millivolts to 100 millivolts greater than the initial oxidation-reduction potential of the slurry, depending upon the oxidation state of the sulfide minerals.

Also during this process, at least one collector which is selected from the group comprising a sulphydryl, a collector having a carbon chain length comprising about 1 to 6 carbon atoms, a xanthogenate and/or a dithiophosphate may be used, as well as other suitable collectors that are known to one skilled in the art. Further, at least one frother is used that may selected from the group comprising high molecular-weight alcohols, methyl isobutyl carbinol (MIBC), polyglycol ethers, Dowfroth® 250, Cyanamid R65™, Union Carbide PG400™, or a combination of the foregoing. Further, other frothers known to one skilled in the art may be used. The particles may also be ground or reground to a preferred particle size.

This process may also include the use of closed or covered cells or reactor during ozone treatment, and possibly other stages of the process. When the cell or reactor is closed or covered, in an aspect of the invention, the gas that exits from the slurry may be collected. Additionally, the exiting gas may be monitored and/or measured for ozone in real or nearly real time. Further, any ozone in the gas phase exiting the conditioning reactor may be destroyed using heat and/or a solid catalyst at room temperature. When the cell is closed or covered, the method may also be operated at up to a pressure of about 15 psig.

This method may be operated at room or ambient temperature and/or ambient pressure.

During the process, the temperature and/or particle size in real or nearly real time.

The recovery of minerals may be enhanced by this process. In some cases reagents that are specific to a certain mineral can also be added to enhance mineral recover. For example, copper sulfate that is added in the presence of zinc, enhances the recovery of zinc. The process yields a recovery of zinc that is enhanced by at least about 5% to at least about 10%, and iron sulfide content is decreased by up to about 5%. Even without adding other special reagents, zinc grade can be increased up to about 5% depending what stream is taken in the flotation circuit, and iron grade can be decreased up to at least about 5%.

In copper recovery, the desired pH is about pH 8 to pH 11, and the recovery of copper is enhanced by at least about 2% to at least about 5%, and iron sulfide content may be decreased by at least about 3%.

With respect to the recovery of the nickel, nickel was kept constant or nearly constant, but the iron recovery in the concentrate decreases up to about 10 points. Further, the grade of nickel increases about 1% while iron decreases up to about 8%.

The invention also contemplates a method of decreasing sulfide emissions during heat treatment of mineral sulfide containing minerals, that comprises obtaining a slurry which has been conditioned with at least collector and/or frother and oxygen which comprises less desirable iron sulfide particles and other more desirable mineral particles, some of which are sulfides; supplying at least about 3.5%–15% ozone gas to the slurry for sufficient time to degrade the frothers and collectors in the slurry and the collectors which have absorbed to the particles and for a time sufficient to oxidize the surface of the iron sulfide minerals faster than the surface of the other more desired sulfide minerals; agitating the slurry during ozonation at about 200 rpm to 3000 rpm; adding at least one fresh collector and at least one fresh frother to the mineral particles which have been subjected to ozonation; refloating the floatable particles with air; further separating the more desired particles from the less desired iron sulfate particles in the slurry; obtaining mineral sulfide particles with a decrease iron sulfide concentration; and heat treating and/or further processing the obtained particles by heat in excess of 200° C., depending upon the mineral.

As an aspect of this method, any other flotation reagents to enhance flotation and/or recovery of the desired mineral particles may be added. Typically, the desired mineral sulfide containing minerals comprise copper or nickel.

With respect to heat treatment or further processing, the copper or nickel can be smelted in the traditional manner, as known by one skilled in the art. Due to the decreased iron sulfide content, there are decreased sulfide emissions. Copper and nickel may be smelted at temperatures that are appropriate and are known to one skilled in the art such as 1000° C. to 1700° C. or more.

Where the desired mineral sulfide containing minerals comprise zinc, the zinc may be roasted as is known by one skilled in the art, as a further treatment process. Due to the decreased iron sulfide content, there are decreased sulfide emissions. Zinc may be heated up to or greater than 400° C.

As discussed above, ozone, is a more powerful oxidant than oxygen and more effective in terms of oxygen consumption. The ozone consumption, which ranges between 0.25 to 4.0 kg/treated ton is more effective economical than the oxygen consumption around 150 kg/ton. Ozone, is also able to destroy organics in a wide range of pH (2 to 12) and to effectively oxidize selectively mineral sulfide particles at selected stages during flotation, thus increasing the recovery of the desired minerals.

The scope of the present invention is not limited to any claim or to just embodiments discussed and claimed herein, or the accompanying figures.

We claim:

1. A method of separating iron sulfide mineral particles from other mineral sulfide value particles containing zinc, nickel and/or copper by using ozone during certain flotation steps to at least degrade the frothers and collectors in the slurry liquid and/or remove the collectors adsorbed on the surface of said particles, comprising:

(a) obtaining a slurry comprised of less desirable iron sulfide mineral particles and more desirable mineral sulfide particles containing mineral values of zinc, nickel and/or copper, wherein said particles are of a preferred particle size;

(b) adjusting and/or maintaining the pH of said slurry to a desired level between about pH 8.0 and pH 12 at least one time;

(c) adding at least one collector to the slurry that adsorbs on at least a portion of said particles and adding at least one frother to said slurry;

(d) conditioning the slurry during and/or after said collector is added to obtain flotation conditions for at least some of said particles;

(e) subjecting the conditioned slurry to flotation and obtaining a flotation concentrate stream and a flotation tailings stream, wherein said concentrate stream comprises the more desirable mineral sulfide value particles and wherein the tailings stream comprises the less desirable iron sulfide particles;

(f) treating the concentrate stream and/or the tailings stream with at least about 3.5%–15% ozone for a time and/or concentration sufficient to at least degrade the frother and collector in the liquid phase and/or to remove the collectors adsorbed on the surface of said particles;

(g) further treating or supplying the concentrate stream and/or the tailings stream with at least about 3.5%–15% ozone for a time and/or concentration sufficient to oxidize the surface of iron sulfide minerals faster than the surface of the other more desired sulfide minerals;

(h) agitating the concentrate and/or tailings stream during at least step (f); and (i) subjecting the agitated stream from step (h) to a second flotation to further separate the more desired mineral sulfide particles from the less desired iron sulfide particles in the concentrate and/or tailings stream.

2. The method of claim 1, further comprising the steps of:

adding at least one new collector and/or at least one new frother after ozone treatment to refloat the said concentrate and/or tailings stream and subjecting the concentrate and/or tailing stream to said second flotation to further separate the more desirable mineral sulfide particles from the less desirable iron sulfide particles; and obtaining from said second flotation a second flotation concentrate stream and a second flotation tailings stream, wherein said second concentrate stream comprises the more desirable mineral sulfide value particles and wherein the second tailings stream comprises the less desirable iron sulfide particles.

3. The method of claim 2, further comprising the step of:

adding any other required flotation reagents after ozone treatment to refloat the floatable particles with air.

4. The method of claim 1, further comprising the step of:

adding copper sulfate in presence of zinc, wherein the recovery of zinc is enhanced.

5. The method of claim 1, wherein the surface of the iron sulfide minerals is partially and/or totally oxidized during step (g).

6. The method of claim 1, further comprising the step of agitating said slurry and/or streams during any and/or all of steps (a)–(i).

7. The method of claim 1, wherein said concentrate and/or tailings stream is agitated during ozone treatment to adequately disperse the ozone gas.

8. The method of claim 7, wherein said concentrate and/or tailings stream is agitated at about 200 rpm to 3000 rpm.

9. The method of claim 1, wherein said at least one collector is selected from the group comprising a sulphydryl, a collector having a carbon chain length comprising about 1 to 6 carbon atoms, a xanthogenate, and/or a dithiophosphate.

10. The method of claim 1, wherein said ozone is provided by an ozone generator fed with oxygen or dry air.

11. The method of claim 1, wherein said slurry is conditioned with a base for a time period of at least about 2 minutes to about 30 minutes.

12. The method of claim 1, wherein said ozone is used in step (f) and/or (g) for a time period of at least about 2 minutes to about 30 minutes, depending upon the concentration of said ozone.

13. The method of claim 10, wherein said ozone generator is fed with oxygen and said concentrate stream and/or said tailings stream is treated with at least about 3.5%–15% ozone for at least about 5 to 25 minutes in step (f) and/or (g), depending upon the concentration of said ozone.

14. The method of claim 10, wherein said ozone generator is fed with oxygen and said concentrate stream and/or said tailings stream is treated with at least about 8%–15% ozone for at least about 5 to 15 minutes in step (f) and/or (g), depending upon the concentration of said ozone.

15. The method of claim 10, wherein said ozone generator is fed with oxygen and said ozone in step (t) and/or (g) preferably comprises at least about 10%–14% ozone.

16. The method of claim 1, wherein said ozone generator is fed with air and said concentrate stream and/or said tailings stream is treated with at least about 3.5%–4.5% ozone for at least about 5 to 60 minutes in step (f) and/or (g).

17. The method of claim 10, wherein said concentrate stream and/or said tailings stream consumes about between about 0.25 to 4.0 kg ozone/treated ton of particles during step (f) and/or (g), depending upon the sulfur content in the ore and degree of oxidation.

18. The method of claim 1, wherein said preferred particle size comprises particles having a mean particle size of about 45 to 120 microns.

19. The method of claim 1, wherein said preferred particle size comprises particles substantially of about 20 to 250 microns.

20. The method of claim 1, wherein the pH comprises about pH 8 to pH 12, and wherein the potential referred to the standard hydrogen electrode of said slurry and/or concentrate stream or tailings stream is between 450 mV and 230 mV, respectively.

21. The method of claim 20, wherein said oxidation reduction potential is raised to a level from about +5 millivolts to about 100 millivolts greater than the initial oxidation reduction potential of the slurry, depending upon the oxidation state of the sulfide minerals.

22. The method of claim 1, wherein said at least one frother is selected from the group comprising high molecular-weight alcohols, methyl isobutyl carbinol (MIBC), polyglycol ethers, Dowfroth® 250, Cyanamid R65™, Union Carbide PG400™, or a combination of the foregoing.

23. The method of claim 22, wherein said collector comprises a xanthogenate and wherein said frother comprises MIBC.

24. The method of claim 1, further comprising the step of measuring pH and/or redox potential in real or nearly real time.

25. The method of claim 1, further comprising the step of measuring dissolved ozone and dissolved oxygen in the concentrate and/or tailings stream during and after ozone treatment in real or nearly real time.

26. The method of claim 1, further comprising the step of using a closed or covered reactor or cell during step (f) and/or (g).

27. The method of claim 26, further comprising the step of collecting gas that exits from the tailings stream and/or concentrate stream.

28. The method of claim 26, further comprising the step of monitoring and/or measuring any ozone in said exiting gas in real or nearly real time.

29. The method of claim 27, further comprising the step of destroying any ozone in the gas phase exiting the reactor or cell using heat and/or a solid catalyst at room temperature.

30. The method of claim 1, operated at temperatures up to about 100° C.

31. The method of claim 1, operated at room temperature.

32. The method of claim 1, operated at ambient pressure.

33. The method of claim 26, operated at a pressure of about up to 15 psig.

34. The method of claim 1, further comprising the step of measuring temperature and/or particle size in real or nearly real time.

35. The method of claim 22, wherein the desired pH is about pH 8 to pH 11, and copper recovery is enhanced by at least about 2% to at least about 5%.

36. The method of claim 35, wherein iron sulfide content is decreased by up to about 3%.

37. The method of claim 4, wherein the recovery of the zinc is enhanced at least about 5% to at least about 10%, and wherein iron sulfide content is decreased by up to about 5%.

38. The method of claim 37, wherein the zinc grade can be increased up to 5%, and wherein iron grade can be decreased up to about 5%.

39. The method of claim 17, wherein the recovery of the nickel is about constant but the iron recovery in the concentrate is decreased up to about 10 points.

40. The method of claim 39, wherein the grade of nickel increases about 1% and wherein iron decreases about 80%.

41. The method of claim 1, further comprising the step of grinding and/or regrinding said particles to a preferred particle size.

42. The method of claim 1, wherein said tailings and/or said concentrate is further subjected to steps (b)–(i) at least once.

43. A method for separating ore material comprising gangue, iron sulfide minerals, and other minerals containing mineral values of at least zinc, nickel and/or copper at least some of which are in sulfide form, comprising:

(a) obtaining ore particles of a preferred size and/or grounding ore materials to a preferred particle size;

(b) forming a slurry comprised of at least water, less desirable iron sulfide mineral particles, gangue, and more desirable mineral particles containing mineral values of zinc, nickel and/or copper, at least some of which are in sulfide form;

(c) adjusting and/or maintaining the pH of said slurry to a desired level between about pH 8.0 and pH 12 at least one time;

(d) adding at least one collector to the slurry and at least one frother to said slurry;

(e) raising and/or maintaining the potential of the slurry to a level sufficient for the collector to adsorb onto at least the sulfide particles;

conditioning the slurry to obtain flotation conditions for at least some of said particles;

subjecting the conditioned slurry to flotation a flotation concentrate stream and a flotation tailings stream, wherein said concentrate stream comprises the more desirable mineral particles and wherein the tailings stream comprises the less desirable iron sulfide particles and gangue;

(f) treating the concentrate stream and/or the tailings stream with at least about 3.5%–15% ozone for a time and/or concentration sufficient to at least degrade the frother and collector in the liquid phase and/or to remove the collectors adsorbed on the surface of said particles;

(g) agitating the concentrate and/or tailings stream during at least step (f); and (h) subjecting the agitated stream from step (g) to a second flotation step to further separate the more desired mineral particles from the less desired iron sulfide particles in the concentrate and/or tailings stream.

44. The method of claim 43, further comprising the steps of:

adding at least one new collector and/or at least one new frother after ozone treatment to said concentrate and/or tailings stream and subjecting the concentrate and/or tailing stream to said second flotation to further separate the more desirable mineral sulfide particles from the less desirable iron sulfide particles; and obtaining from said second flotation a second flotation concentrate stream and a second flotation tailings stream, wherein said second concentrate stream comprises the more desirable mineral particles, some of which are sulfides iron, and wherein the second tailings stream comprises the less desirable iron particles.

45. The method of claim 44, further comprising the step of:

adding any other required flotation reagents after ozone treatment to refloat the floatable particles with air and/or to enhance recovery of the more desirable minerals.

46. The method of claim 43, further comprising the steps of:

further treating the concentrate stream and/or the tailings stream with at least about 3.5%–15% ozone for a time and/or concentration sufficient to oxidize the surface of the iron sulfide minerals faster than surface of the other more desired sulfide minerals; and agitating the concentrate and/or tailings stream during oxidation.

47. The method of claim 46, wherein the surface of the iron sulfide minerals is partially and/or totally oxidized by said ozone treatment.

48. The method of claim 43, wherein the tailings stream and/or concentrate stream further undergoes at least steps (c)–(e).

49. The method of claim 43, wherein the flotation comprises a bulk and/or differential flotation.

50. The method of claim 43, wherein said ozone is provided by an ozone generator fed with oxygen or dry air.

51. The method of claim 43, wherein said concentrate stream and/or tailings stream consumes between about 0.25 to 4.0 kg ozone/treated ton in step (f).

52. The method of claim 46, wherein said concentrate stream and/or tailings stream consumes between about 0.25 to 4.0 kg ozone/treated ton.

53. The method of claim 43, wherein said concentrate stream and/or tailings stream is treated for about 3 minutes to about 30 minutes with at least about 3.5–15% ozone, depending upon ozone concentration.

54. The method of claim 46, wherein said concentrate stream and/or tailings stream is treated for at least about 3 minutes to about 30 minutes with at least about 10–13% ozone, depending on ozone concentration.

55. The method of claim 43, wherein the preferred particle size comprise particles wherein the majority of said particles are about 75–150 microns in size.

56. The method of claim 43, wherein the pH preferably comprises about pH 9 to pH 12.

57. The method of claim 56, wherein the potential referred to as the standard hydrogen electrode of said slurry and/or concentrate stream or tailings stream is between about 450 mV and 230 mV, respectively.

58. The method of claim 57, wherein said added ozone increases the oxidation reduction potential at least about +5 millivolts to about 100 millivolts greater than the initial reduction potential of the slurry, depending upon the oxidation state of the sulfide minerals.

59. The method of claim 46, wherein said concentrate stream or tailings stream is agitating during ozone treatment at about 200 rpm to 3000 rpm.

60. The method of claim 43, wherein said at least one collector is selected from the group comprising a sulphydryl, a xanthogenate, a dithiophosphate or a combination thereof.

61. The method of claim 43, wherein said at least one collector has a carbon chain length comprising about 1 to 6 carbon atoms.

62. The method of claim 43, wherein said at least one frother is comprised of high molecular-weight alcohols, methyl isobutyl carbinol (MIBC), polyglycol ethers, Dowfroth® 250, Cyanamid R65™, Union Carbide PG400™, or a combination of the foregoing.

63. The method of claim 43, further comprising the step of measuring in real or nearly real time at least one of the following parameters comprising pH; ozone saturation; oxygen saturation; redox potential or a combination of the foregoing.

64. The method of claim 43, wherein said concentrate stream or tailings stream is covered and/or enclosed during ozone treatment.

* * * * *

UNITED STATES PATENT AND TRADEMARK OFFICE

CERTIFICATE OF CORRECTION

PATENT NO. : 7,152,741 B2
APPLICATION NO. : 10/365100
DATED : December 26, 2006
INVENTOR(S) : Javier Jara and Yawo Zuttah It is certified that error appears in the above-identified patent and that said Letters Patent is hereby corrected as shown below:

Column 21, claim 15, line 21, delete " (t) " and replace with -- (f) --

Column 22, claim 40, line 34, delete " 80% " and replace with -- 8% --

Signed and Sealed this

First Day of May, 2007

JON W. DUDAS
*Director of the United States Patent and Trademark Office*